US008398069B2

(12) United States Patent
Chae et al.

(10) Patent No.: US 8,398,069 B2
(45) Date of Patent: Mar. 19, 2013

(54) PAPER FEEDER WITH FIRST AND SECOND PAPER LOADERS

(75) Inventors: Seok Heon Chae, Hwaseong-si (KR); Min Gi Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/137,858

(22) Filed: Sep. 19, 2011

(65) Prior Publication Data

US 2012/0074640 A1 Mar. 29, 2012

(30) Foreign Application Priority Data

Sep. 27, 2010 (KR) ..... 10-2010-0093148

(51) Int. Cl.
*B65H 3/44* (2006.01)

(52) U.S. Cl. ..... 271/9.08; 271/9.03; 271/9.06; 271/9.12; 271/164

(58) Field of Classification Search ..... 271/9.01, 271/9.02, 9.03, 9.08, 9.12, 164, 145, 9.06; 414/795.8; 399/389, 391
See application file for complete search history.

(56) References Cited

U.S. PATENT DOCUMENTS 5,102,112 A * 4/1992 Takahashi ..... 271/9.08
5,150,893 A * 9/1992 Uno et al. ..... 271/157
5,335,903 A * 8/1994 Martin et al. ..... 271/157
5,971,387 A * 10/1999 Kita ..... 271/9.03

FOREIGN PATENT DOCUMENTS

JP 03138227 A * 6/1991

* cited by examiner

*Primary Examiner* — Jeremy R Severson
(74) *Attorney, Agent, or Firm* — Staas & Halsey LLP

(57) ABSTRACT

A paper feeder, a control method thereof, and an image forming apparatus having the same are provided. The paper feeder includes a moving member to push paper loaded on one paper loader to another empty paper loader. With regard to operation of the moving member, the stop time of the moving member may be variable based on a paper size input by a user, which enables a stop position of the moving member to be automatically adjusted based on the paper size, resulting in enhanced user convenience.

19 Claims, 14 Drawing Sheets

PAPER FEEDER WITH FIRST AND SECOND PAPER LOADERS

CROSS-REFERENCE TO RELATED APPLICATIONS

This application claims the priority benefit of Korean Patent Application No. 2010-0093148, filed on Sep. 27, 2010 in the Korean Intellectual Property Office, the disclosure of which is incorporated herein by reference.

BACKGROUND

1. Field

Embodiments relate to a paper feeder, a control method thereof, and an image forming apparatus having the same, the paper feeder being configured to receive a number of sheets of paper, which reduces the frequency at which paper must be supplied.

2. Description of the Related Art

An image forming apparatus is designed to form an image on a printing medium based on an input image signal. Examples of image forming apparatuses include printers, copiers, fax machines, and devices combining functions thereof.

In operation of the image forming apparatus, a photoconductor, which has been charged with a predetermined electric potential, is exposed to light such that an electrostatic latent image is formed on a surface of the photoconductor and subsequently, a developing unit provides the electrostatic latent image with developer to form a developer image. The developer image formed on the photoconductor may be transferred to paper directly or by way of an intermediate transfer unit. Finally, the image transferred to the paper is fixed to the paper via fusing.

The image forming apparatus includes a paper feeding cassette in which several sheets of paper are received so as to be fed upon image forming.

Recently, regardless of the presence of the paper feeding cassette, the image forming apparatus tends to employ a High Capacity Feeder (HCF), which is designed to successively feed a number of sheets of paper into the image forming apparatus.

A conventional high capacity feeder includes a first paper loader to receive paper to be fed into the image forming apparatus, a second paper loader to receive paper to be fed into the first paper loader, a moving member to push and move the paper received in the second paper loader to the first paper loader, and a sensing unit to sense whether or not the moving member has reached a reference position so as to know when to stop the moving member.

With regard to operation of the high capacity feeder having the above-described configuration, if the first paper loader is completely out of paper, the paper received in the second paper loader is moved into the first paper loader by operation of the moving member. The moving member stops operation if the sensing unit senses that the moving member has reached the reference position.

The high capacity feeder, however, has difficulty changing the stop time of the moving member based on the size of paper because it has no ability to know the size of paper.

Therefore, the conventional high capacity feeder always stops the moving member at the same time regardless of the size of paper, and it may be necessary to inconveniently adjust a position of the sensing unit based on the size of paper to be used in the high capacity feeder, prior to initiating operation of the high capacity feeder.

SUMMARY

According to an aspect of one or more embodiments, there is provided a paper feeder, a control method thereof, and an image forming apparatus having the same, in which a moving member is used to move paper received in one paper loader to another empty paper loader, a stop time of the moving member being variable based on a paper size input by a user.

According to an aspect of one or more embodiments, there is provided a paper feeder which includes a paper feeder housing provided in an image forming apparatus, a first paper loader placed in the paper feeder housing to load paper to be fed into the image forming apparatus, a second paper loader placed in the paper feeder housing to load paper to be fed into the first paper loader, a movement unit having a moving member to move the paper loaded on the second paper loader to the first paper loader, and a controller to control the movement unit such that the moving member is moved to move the paper loaded on the second paper loader to the first paper loader if the first paper loader is out of paper and such that a stop time of the moving member is variable based on the size of paper input by a user during movement of the moving member.

The controller may vary the stop time of the moving member on a per paper size basis based on when the moving member has reached a reference position.

The paper feeder may further include a sensor to sense that the moving member has reached the reference position.

The controller may vary the stop time of the moving member on a per paper size basis based on when the moving member begins to move.

The controller may receive the size of paper input by the user from the image forming apparatus.

According to an aspect of one or more embodiments, there is provided a control method of a paper feeder including a first paper loader placed in a paper feeder housing of an image forming apparatus to load paper to be fed into the image forming apparatus, a second paper loader placed in the paper feeder housing to load paper to be fed into the first paper loader, and a moving member to move the paper loaded on the second paper loader to the first paper loader, includes receiving a paper size input by a user, moving the moving member to move the paper loaded on the second paper loader to the first paper loader if the first paper loader is out of paper, and stopping the moving member at a stop time variably set based on the received paper size.

Stopping the moving member at a stop time variably set based on the received paper size may include sensing that the moving member has reached a reference position using a sensor, calculating the stop time of the moving member on a per paper size basis based on when the moving member has reached the reference position, and stopping the moving member at the calculated stop time.

The variably set stop time of the moving member may decrease as the received paper size increases and the variably set stop time of the moving member may increase as the received paper size decreases.

Stopping the moving member at a stop time variably set based on the received paper size may include calculating the stop time of the moving member on a per paper size basis based on when the moving member begins to move, and stopping the moving member at the calculated stop time.

The calculated stop time of the moving member may decrease as the received paper size increases and the calculated stop time of the moving member may increase as the received paper size decreases.

According to an aspect of one or more embodiments, there is provided an image forming apparatus which includes a paper feeder housing, a first paper loader placed in the paper feeder housing to load paper to be fed into an image forming unit, a second paper loader placed in the paper feeder housing to load paper to be fed into the first paper loader, a movement unit having a moving member to move the paper loaded on the second paper loader to the first paper loader, an input unit to receive a paper size from a user, an image forming control unit to control the image forming apparatus and to transmit the paper size input via the input unit, and a controller to control the movement unit such that the moving member is moved to move the paper loaded on the second paper loader to the first paper loader if the first paper loader is out of paper and such that a stop time of the moving member is variable based on the size of paper transmitted from the image forming control unit during movement of the moving member.

The image forming apparatus may further include a sensor to sense that the moving member has reached a reference position, and the controller may vary the stop time of the moving member on a per paper size basis based on when the moving member has reached the reference position.

The controller may vary the stop time of the moving member on a per paper size basis based on when the moving member begins to move.

The controller may vary the stop time of the moving member such that the stop time decreases as the paper size transmitted from the image forming control unit increases and such that the stop time increase as the paper size transmitted from the image forming control unit decreases.

According to an aspect of one or more embodiments, there is provided a paper feeder which includes first and second paper loaders to load paper thereon, a movement unit having a moving member to move the paper loaded on the second paper loader to the first paper loader, and a controller to control the moving member to move the paper loaded on the second paper loader to the first paper loader if the first paper loader is out of paper and to vary a movement distance of the moving member based on the size of paper input by a user during movement of the moving member.

The controller may vary the movement distance of the moving member such that the movement distance decreases as the input paper size increases and such that the movement distance increases as the input paper size decreases.

The paper feeder may further include a sensor to sense that the moving member has reached a reference position, and the controller may vary the movement distance of the moving member on a per paper size basis based on when the moving member has reached the reference position.

According to an aspect of one or more embodiments, there is provided a control method of a paper feeder to a feed paper to an image forming apparatus, the control method including receiving a paper size input by a user, moving a moving member to move the paper loaded on a paper loader to another paper loader if the paper loader is out of paper, and stopping the moving member at a stop time variably set based on the received paper size.

BRIEF DESCRIPTION OF THE DRAWINGS

These and/or other aspects of embodiments will become apparent and more readily appreciated from the following description of embodiments, taken in conjunction with the accompanying drawings of which.

DETAILED DESCRIPTION

Figure 1:
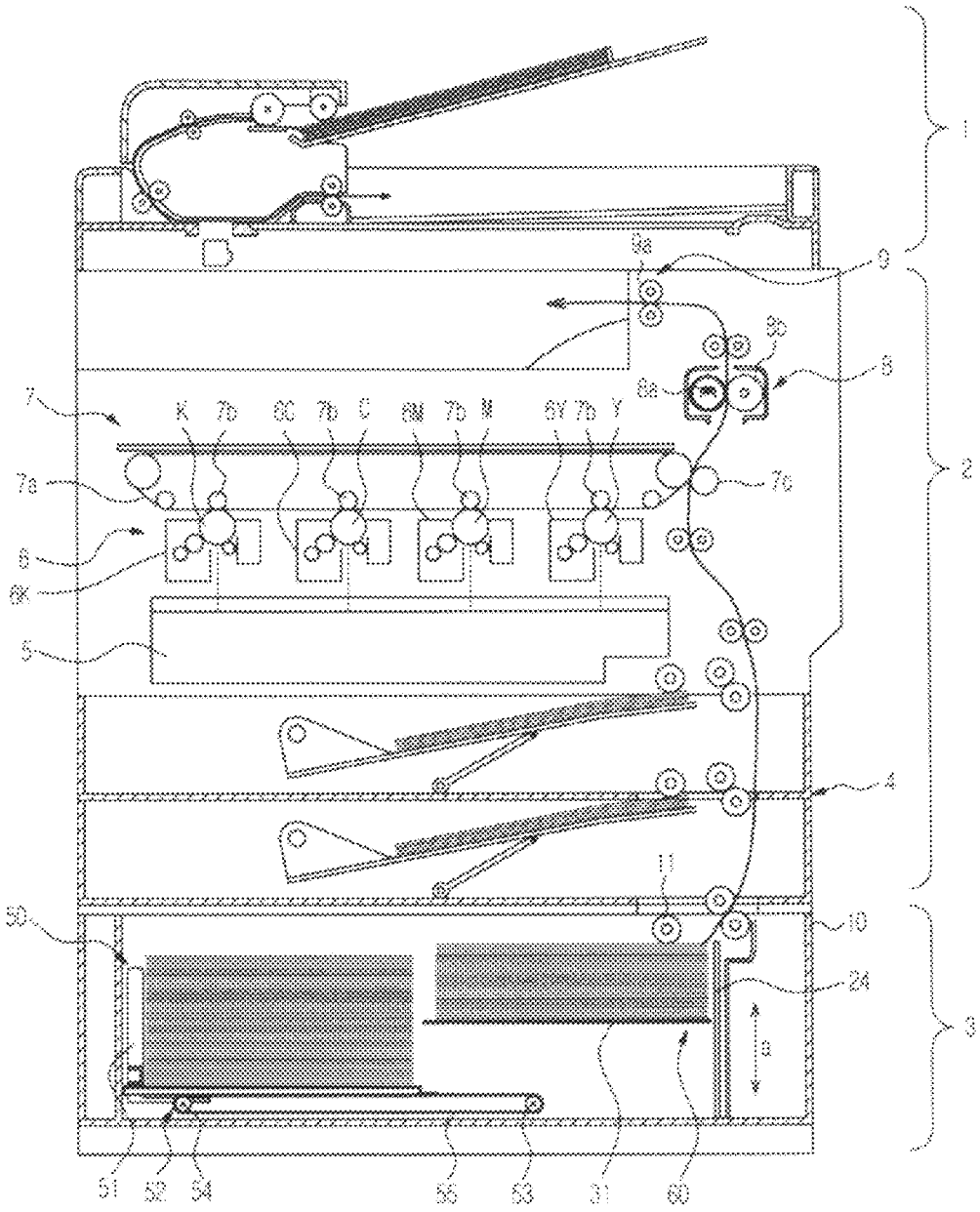
FIG. 1 is a sectional view illustrating an image forming apparatus according to an embodiment.

Reference will now be made in detail to embodiments, examples of which are illustrated in the accompanying drawings, wherein like reference numerals refer to like elements throughout.

FIG. 1 is a sectional view illustrating an image forming apparatus according to an embodiment.

Referring to FIG. 1, the image forming apparatus includes an image reading unit 1 to read an image recorded on a document, an image forming unit 2 to form and print an image on paper, and a paper feeder 3 configured to receive a number of sheets of paper to minimize the frequency at which paper must be supplied.

The image forming unit 2 functions to form an image based on a signal from the image forming unit 1 or an external appliance, such as a host computer and to print the resulting image on paper.

To this end, the image forming unit 2 includes a paper feeding unit 4, a light scanning unit 5, a developing unit 6, a transfer unit 7, a fusing unit 8, and a paper discharge unit 9.

The light scanning unit 5 irradiates light corresponding to image information to photoconductors K, C, M and Y to form electrostatic latent images on surfaces of the photoconductors K, C, M and Y.

The developing unit 6 feeds developers to the electrostatic latent images formed on the photoconductors K, C, M and Y to form developer images. The developing unit 6 may be composed of four developing units 6K, 6C, 6M and 6Y, in which different colors of developers, for example, black (K), cyan (C), magenta (M), and yellow (Y) developers are received respectively.

The transfer unit 7 includes an intermediate transfer belt 7*a*, first transfer rollers 7*b*, and a second transfer roller 7*c*. The developer images formed on the photoconductors K, C, M and Y are transferred to the intermediate transfer belt 7*a* via the first transfer rollers 7*b* and in turn, the resulting image on the intermediate transfer belt 7*a* is transferred to paper as the paper, which has fed from the paper feeding unit 4, passes between the second transfer roller 7*c* and the intermediate transfer belt 7*a*.

The paper having passed through the transfer unit 7 enters the fusing unit 8. The fusing unit 8 includes a heating roller 8*a* and a pressure roller 8*b*. When the paper, to which the image has transferred, passes between the heating roller 8*a* and the pressure roller 8*b*, the image is fixed to the paper by heat and pressure.

The paper having passed through the fusing unit 8 is guided to the paper discharge unit 9 and is discharged out of a housing 10 of the image forming apparatus. A paper discharge roller is denoted by reference numeral 9*a*.

The paper feeder 3, for example, is a High Capacity Feeder (HCF).

Figure 2:
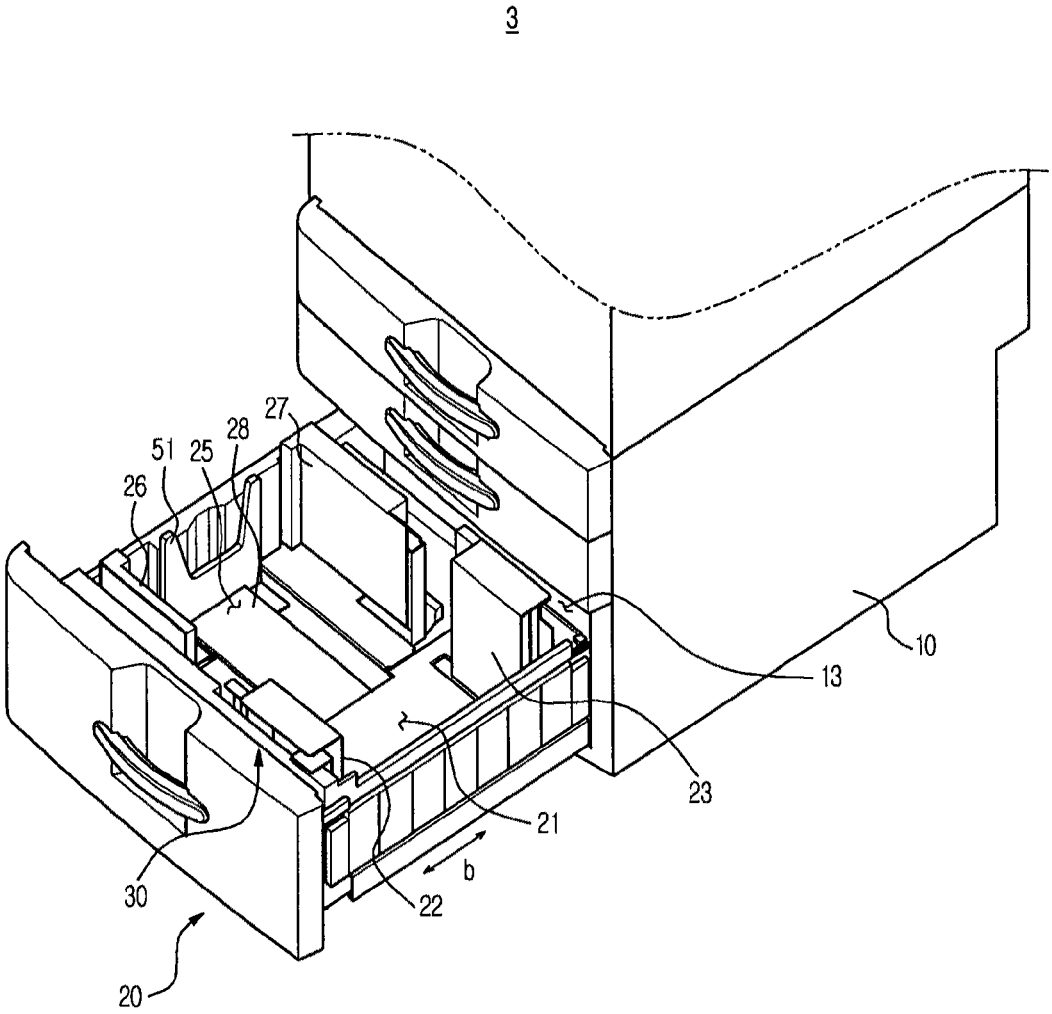
FIG. 2 is a perspective view illustrating a paper feeder according to an embodiment.
Figure 3:
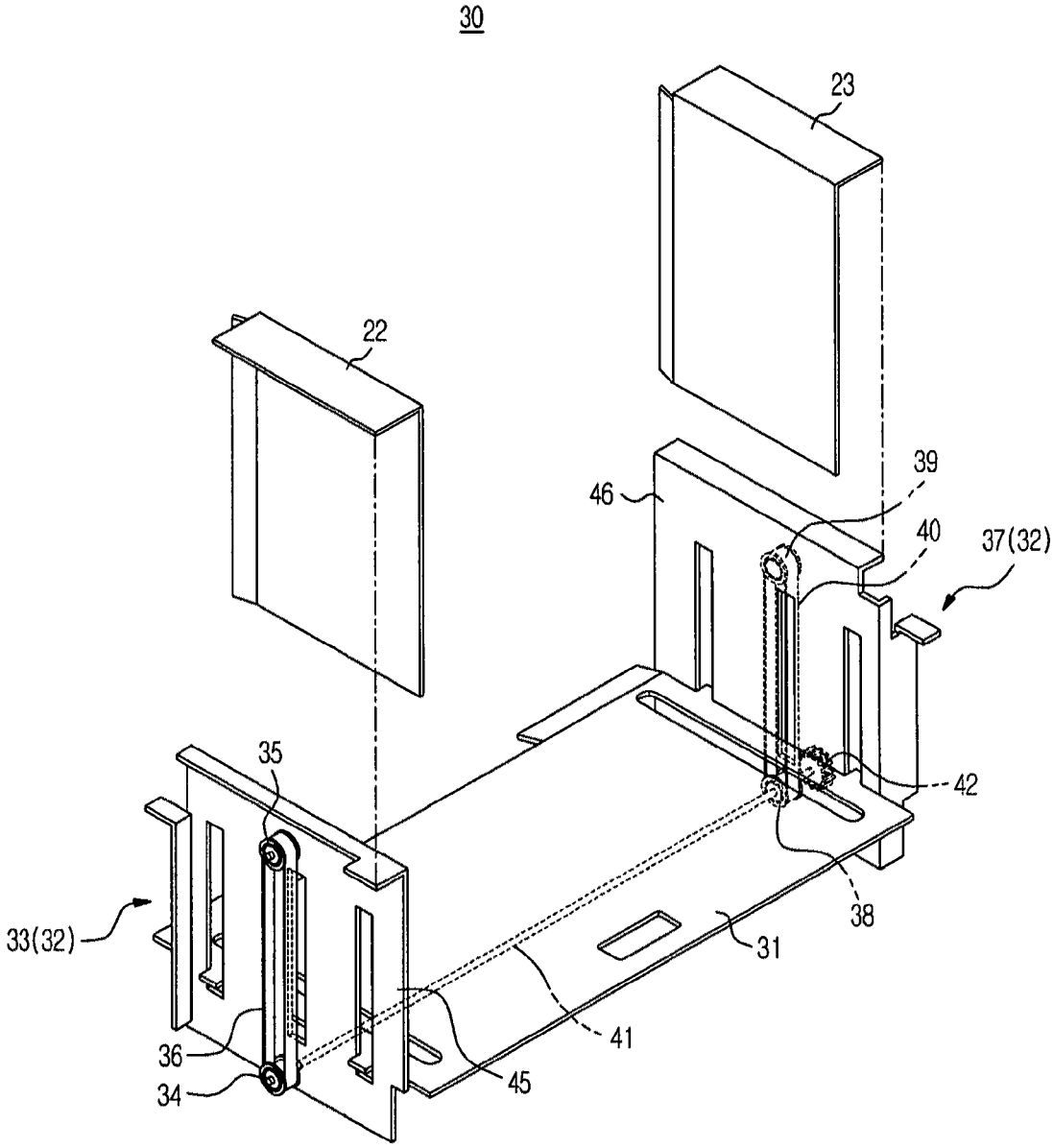
FIG. 3 is a perspective view illustrating a vertical movement unit of the paper feeder according to an embodiment.
Figure 4:
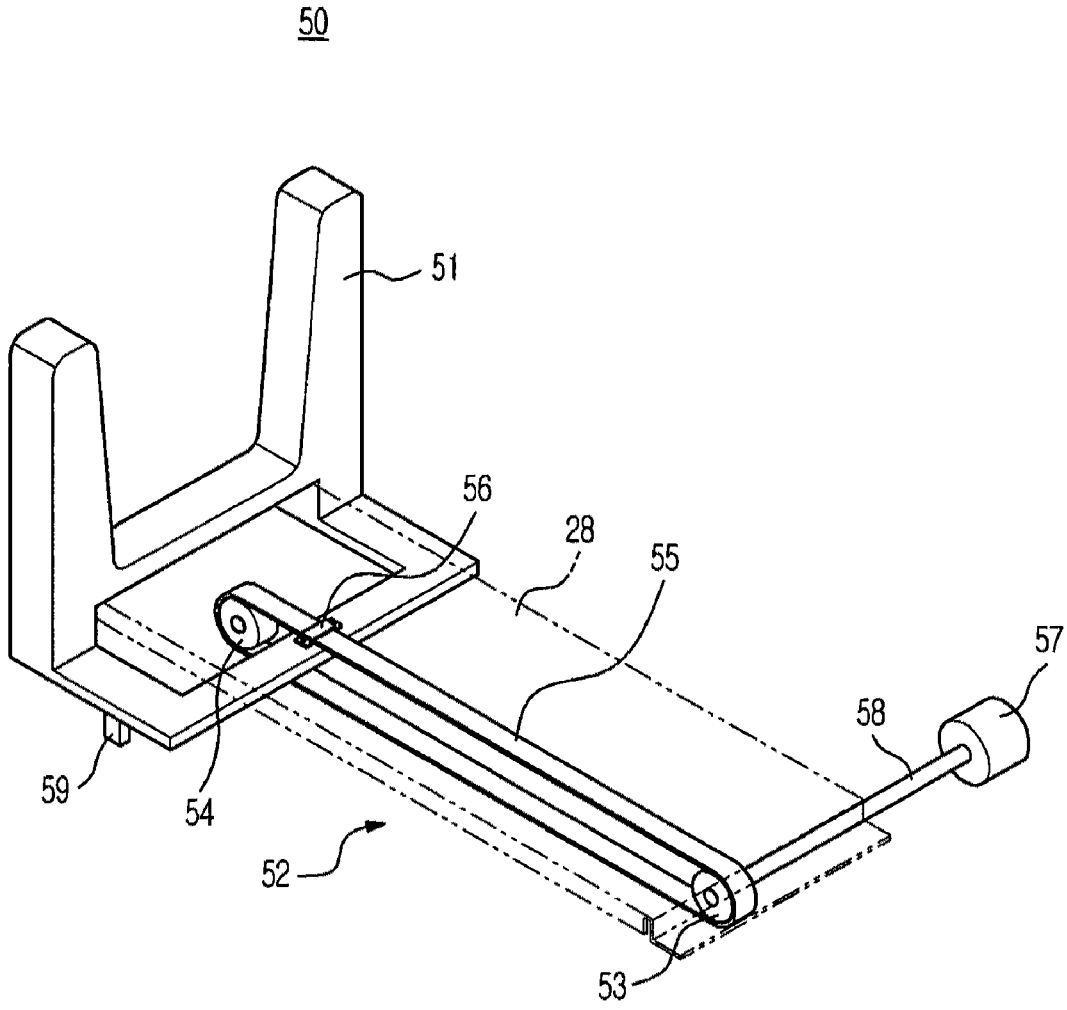
FIG. 4 is a perspective view illustrating a horizontal movement unit of the paper feeder according to an embodiment.
Figure 5:
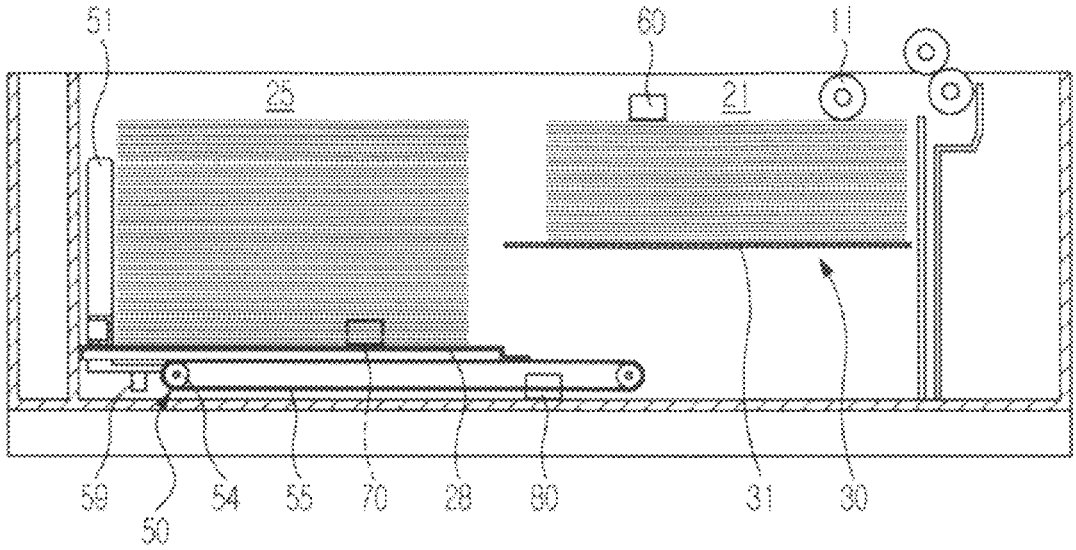
FIG. 5 is a schematic sectional view of the paper feeder according to an embodiment.

FIG. 2 is a perspective view illustrating the paper feeder according to embodiment, FIG. 3 is a perspective view illustrating a vertical movement unit of the paper feeder according to an embodiment, FIG. 4 is a perspective view illustrating a horizontal movement unit of the paper feeder according to an embodiment, and FIG. 5 is a schematic sectional view of the paper feeder according to an embodiment.

As illustrated in FIG. 2, the paper feeder 3 includes a feeder housing 20, a vertical movement unit 30, and a horizontal movement unit 50.

The feeder housing 20 may be pushed into or pulled out of the image forming unit housing 10 through an opening 13 of the housing 10.

Although the paper feeder 3 according to an embodiment is placed in the image forming unit housing 10, the paper feeder 3 may be fabricated separately from or integrally formed with the image forming unit housing 10.

The feeder housing 20 is selectively inserted into or separated from the image forming unit housing 10 through the opening 13 of the image forming unit housing 10.

The feeder housing 20 includes a first paper loader 21, which is provided in a first paper loading space such that paper to be fed into the image forming unit 2 is loaded, and a second paper loader 25 which is provided in a second paper loading space separate from the first paper loading space such that paper to be fed into the first paper loader 21 is loaded.

Paper on the first paper loader 21 is supported by guide plates 22 and 23 in a front-and-rear direction b (i.e. an entrance/exit direction of the feeder housing 20) and is also supported at one end thereof by a guide plate. Paper on the second paper loader 25 is supported by guide plates 26 and 27 in the front-and-rear direction b and is also supported at one end thereof by a moving member 51.

In the paper feeder 3 according to an embodiment, when the first paper loader 21 is completely out of paper, the paper loaded on the second paper loader 25 is moved to the first paper loader 21 by the horizontal movement unit 50.

As illustrated in FIGS. 1 and 3, the vertical movement unit 30 includes an elevating plate 31 and vertical movement drive devices 32. The elevating plate 31 is disposed on the bottom of the first paper loader 21 to support the paper present on the first paper loader 21. The vertical movement drive devices 32 are installed at opposite sides of the first paper loader 21 to raise or lower (up-and-down direction a) the elevating plate 31.

The vertical movement drive devices 32 include a first drive device 33 and a second drive device 37.

The first drive device 33 and the second drive device 37 respectively include driving pulleys 34 and 38 and driven pulleys 35 and 39. The respective driving pulleys 34 and 38 are connected to the corresponding driven pulleys 35 and 39 via timing belts 36 and 40. Either lateral end of the elevating plate 31 is fixed to one end of each timing belt 36 or 40 by a fixing member.

The driving pulley 34 of the first drive device 33 and the driving pulley 38 of the second drive device 37 are connected to each other by a first shaft 41. One end of the first shaft 41 is provided with a driving gear 42, and the driving gear 42 serves to transmit drive power of an elevating drive motor to the first shaft 41. In this case, the elevating drive motor may be mounted in the image forming unit housing 10.

The drive power supplied from the elevating drive motor is transmitted to the driving pulley 34 of the first drive device 33 and the driving pulley 38 of the second drive device 37 via the first shaft 41, causing the timing belts 36 and 40 to rotate at the same linear velocity, which enables the raising/lowering operation of the elevating plate 31.

Reference numerals 45 and 46 represent drive plates provided at opposite sides of the elevating plate 31, which serve not only to guide raising/lowering operation of the elevating plate 31, but also to support certain elements, such as the pulleys, rotatably coupled thereto.

As illustrated in FIG. 4, the horizontal movement unit 50 includes a moving member 51 and a horizontal movement drive device 52 to drive the moving member 51. The moving member 51 is located at one side of the second paper loader 25 and is moved to push the paper on a bottom plate 28 of the second paper loader 25 to the first paper loader 21.

The horizontal movement drive device 52 includes a driving pulley 53, a driven pulley 54, a timing belt 55 having one end supported by the driving pulley 53 and the other end supported by the driven pulley 54, a fixing member 56 to couple the timing belt 55 to the moving member 51, a drive motor 57 to rotate the driving pulley 53 forward or reverse, and a shaft 58 having one end connected to the drive motor 57 and the other end connected to the driving pulley 53.

A sensor bar 59 is provided at a lower surface of the moving member 51. The sensor bar 59 will be sensed by a position sensor (see, reference numeral 80 of FIG. 5) which will be described hereinafter.

Drive power supplied from the drive motor 57 of the horizontal movement drive device 52 is transmitted to the driving pulley 53, causing the timing belt 55 of the horizontal movement unit 50 to be rotated. Thereby, the moving member 51 of the horizontal movement unit 50 secured to the timing belt 55 performs reciprocating motion.

As illustrated in FIG. 5, the paper feeder according to an embodiment includes a first paper sensor 60 to sense when the first paper loader 21 is out of paper and a second paper sensor 70 to sense the presence of paper on the second paper loader 25 when it is necessary to move the paper from the second paper loader 25 to the first paper loader 21.

The first paper sensor 60 may be located near the maximum loading height of paper for the first paper loader 21, so as to sense when the first paper loader 21 is out of paper.

The second paper sensor 70 may be located near the height of the bottom plate 28, so as to sense whether or not paper is present on the second paper loader 25.

The paper feeder includes the position sensor 80 to sense whether or not the moving member 51 of the horizontal movement unit 50 has reached a preset position.

The position sensor 80 is located between the first paper loader 21 and the second paper loader 25 so as to sense movement of the moving member 51 of the horizontal movement unit 50.

When the moving member 51 is moved from the second paper loader 25 to the first paper loader 21 for movement of paper from the second paper loader 25 to the first paper loader 21, the position sensor 80 senses that the moving member 51 has reached a preset position by sensing the sensor bar 59 provided at the moving member 51.

The position sensor 80 serves to judge a stop time or a stop position of the moving member 51 when the moving member 51 of the horizontal movement unit 50 is pushed to move the paper on the second paper loader 25 to the first paper loader 21.

In the paper feeder 3 having the above-described configuration, if the first paper sensor 60 senses that the first paper loader 21 is out of paper and the second paper sensor 70 senses the presence of paper on the second paper loader 25, the elevating plate 31 is lowered and thereafter, the moving member 51 of the horizontal movement unit 50 is pushed to move the paper on the second paper loader 25 to the first paper loader 21.

If the position sensor 80 senses the sensor bar 59 of the moving member 51 being moved, the moving member 51 is stopped based on when the position sensor 80 senses the sensor bar 59, to allow the paper to be moved to a position suitable for the size of paper loaded on the second paper loader 25. In this case, the stop time of the moving member 51 may be previously set to be a variable value based on the size of the paper loaded on the second paper loader 25.

In doing so, the paper loaded on the second paper loader 25 is shifted to an appropriate position on the elevating plate 31, completing movement of paper from the second paper loader 25 to the first paper loader 21.

After the paper is completely moved, the moving member 51 is returned to a home position and simultaneously, the elevating plate 31 is raised to enable the paper to be fed from the first paper loader 21 into the image forming unit 2. Once the first paper loader 21 is elevated by the elevating plate 31, an uppermost sheet of paper on the first paper loader 21 is picked up by a pickup roller 11 so as to be moved upward to the image forming unit 2 in which the developing unit 6, the transfer unit 7, and the fusing unit 8 are arranged.

Figure 6:
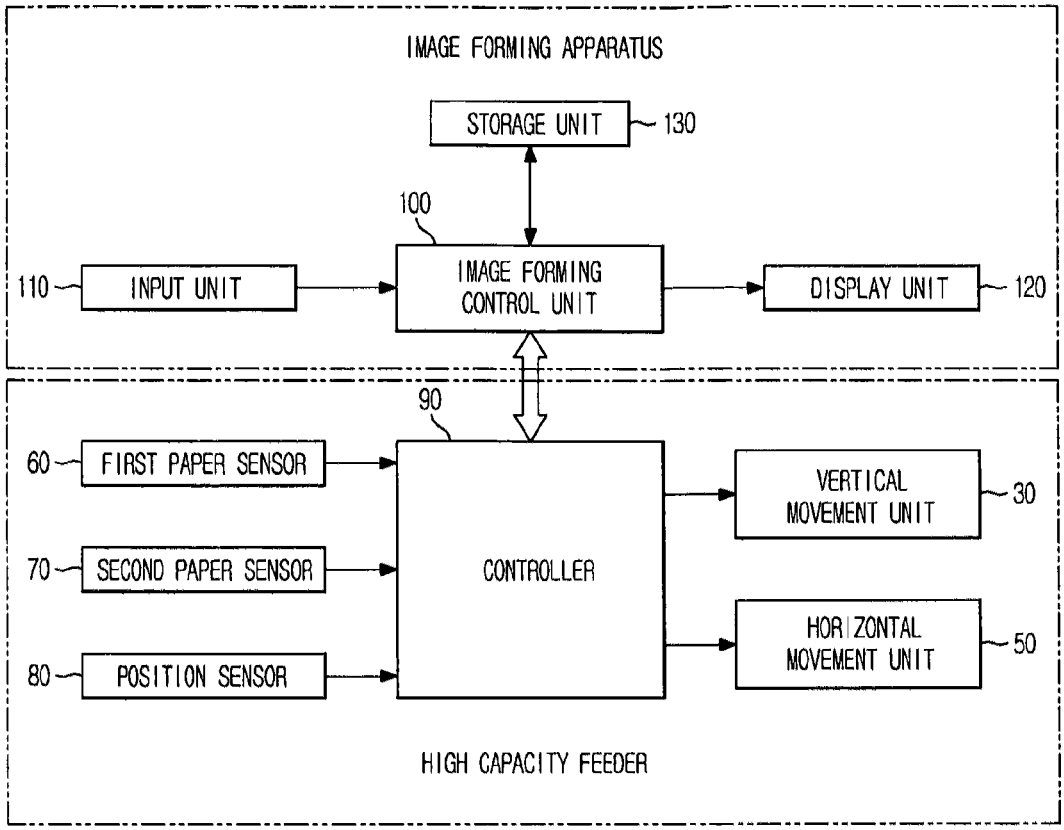
FIG. 6 is a schematic control block diagram of the paper feeder according to an embodiment.

FIG. 6 is a schematic control block diagram of the paper feeder according to an embodiment.

As illustrated in FIG. 6, the paper feeder 3 includes the vertical movement unit 30, the horizontal movement unit 50, the first paper sensor 60, the second paper sensor 70, the position sensor 80, and a controller 90.

The vertical movement unit 30 includes the elevating plate 31 to support the paper loaded on the first paper loader 21. The vertical movement unit 30 lowers the elevating plate 31 when the first paper loader 21 is out of paper. After paper is loaded onto the first paper loader 21, the vertical movement unit 30 raises the elevating plate 31 to a position where the paper loaded on the first paper loader 21 may be fed into the image forming unit 2.

The horizontal movement unit 50 includes the moving member 51 to push and move the paper from the second paper loader 25 to the first paper loader 21. With regard to the paper movement, the horizontal movement unit 50 moves the moving member 51 forward such that the paper loaded on the second paper loader 25 is moved to the first paper loader 21 and then, returns the moving member 51 to an original position thereof after completion of the paper movement to the first paper loader 21.

The first paper sensor 60 senses that the first paper loader 21 is out of paper.

The second paper sensor 70 senses the presence of paper on the second paper loader 25 to perform the paper movement to the first paper loader 21.

The position sensor 80 senses whether or not the moving member 51 has reached a preset position by sensing the sensor bar 59 provided at the moving member 51 while the moving member 51 of the horizontal movement unit 50 is moved from the second paper loader 25 to the first paper loader 21.

The controller 90 senses (determines) that the first paper loader 21 is out of paper using the first paper sensor 60 and senses (determines) the presence of paper on the second paper loader 25 using the second paper sensor 70.

The controller 90 controls the vertical movement unit 30 to lower the elevating plate 31 to enable movement of paper from the second paper loader 25 to the first paper loader 21 when the first paper loader 21 is out of paper. After completion of the movement of paper from the second paper loader 25 to the first paper loader 21, the controller 90 controls the vertical movement unit 30 to raise the elevating plate 31 to enable movement of paper to a position where the paper may be fed into the image forming unit 2.

Additionally, the controller 90 controls the horizontal movement unit 50 to move the moving member 51 forward to enable movement of paper from the second paper loader 25 to the first paper loader 21. After completion of the movement of paper from the second paper loader 25 to the first paper loader 21, the controller 90 controls the horizontal movement unit 50 to return the moving member 51 to an original position thereof.

The controller 90 senses (determines) whether or not the moving member 51 is moved forward from an initial position thereof and has reached a preset position using the position sensor 80.

If the position sensor 80 senses that the moving member 51 has reached the preset position, the controller 90 stops the moving member 51 at a variable stop time based on the input paper size. In this case, the controller 90 has previously received information about the paper size, input by the user, from an image forming control unit 100 that controls the entire image forming apparatus. The paper size input by the user is the size of paper loaded on the second paper loader 25. The stop time of the moving member 51 is previously set to a variable value based on the size of paper loaded on the second paper loader 25. That is, the greater the size of paper loaded on the second paper loader 25, the shorter the stop time of the moving member 51, whereas the smaller the size of paper, the longer the stop time.

Accordingly, it is possible to move the paper from the second paper loader 25 to the first paper loader 21 and to automatically vary the stop time of the moving member 51 based on the size of paper loaded on the second paper loader 25, resulting in enhanced user convenience. Also, it is unnecessary to adjust the position of the position sensor 80 even if the size of paper loaded on the second paper loader 25 varies, which eliminates user inconvenience. In addition, it is possible to vary the stop time of the moving member based on the paper size without installing different sensors to sense different sizes of paper loaded on the second paper loader 25, which reduces manufacturing costs.

The controller 90 controls the horizontal movement unit 50 to return the moving member 51 to an original position thereof upon completion of paper movement and also, controls the vertical movement unit 30 to raise the elevating plate 31 such that the paper loaded on the first paper loader 21 is fed to the image forming unit 2. As such, the uppermost sheet of paper loaded on the second paper loader 21 is picked up by the pickup roller 11 and is moved into the image forming unit 2.

In the meantime, the controller 90 may communicate with the image forming control unit 100 that controls the image forming apparatus.

The image forming control unit 100 is electrically connected to an input unit 110, a display unit 120, and a storage unit 130.

The input unit 110 is provided with a plurality of keys, to receive a user command and to allow the user to select and set functions provided by the image forming apparatus. In particular, the input unit 110 receives user information about the size of paper loaded on the second paper loader 25.

Figure 7:
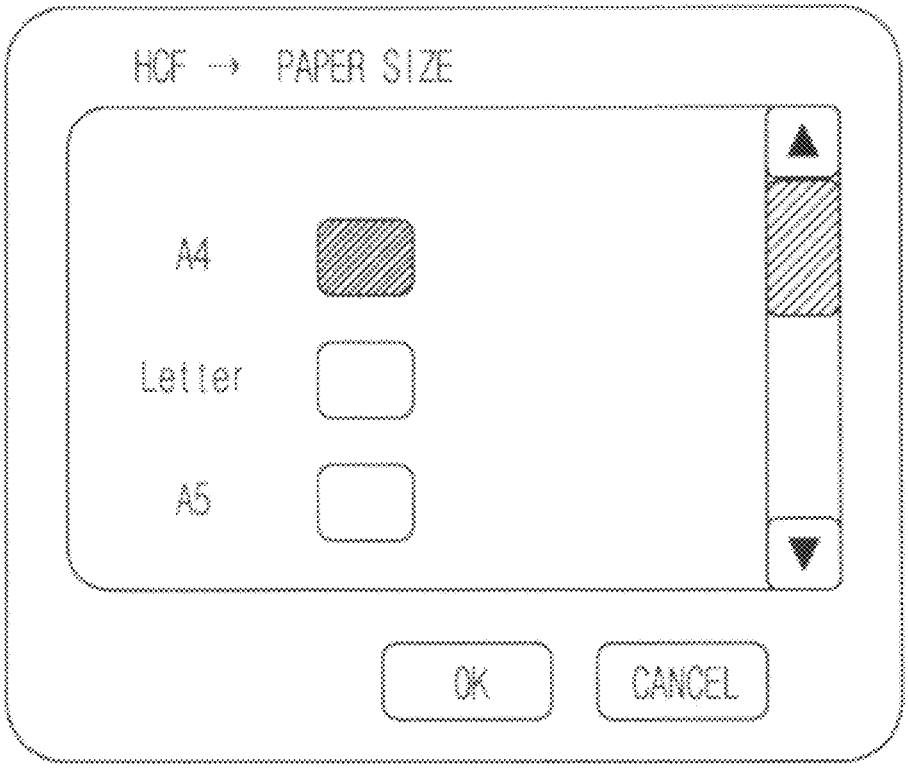
FIG. 7 is a view illustrating a screen image displayed to allow a user to input a paper size into the image forming apparatus including the paper feeder according to an embodiment.

The display unit 120 displays operational state of the image forming apparatus under control of the image forming control unit 100. In particular, the display unit 120 displays a screen image allowing the user to input the size of paper loaded on the second paper loader 25 (see FIG. 7). As illustrated in FIG. 7, the screen image to enable input of the paper size may be provided to select one of A4-size, letter-size, A5-size, etc.

The storage unit 130 stores information related to operation of the image forming apparatus and user input information related to the size of paper loaded on the second paper loader 25.

The image forming control unit 100 controls the entire image forming apparatus and transmits user information related to the size of paper input by the input unit 110 (for example, A4-size, letter-size, A5-size, etc.) to the controller 90 of the paper feeder 3.

Additionally, the image forming control unit 100 includes an image processor and an engine controller for control of the entire image forming apparatus.

The image processor includes a ROM in which a control program and a variety of application programs to drive the image processor are stored, a RAM in which data input from a host computer and a variety of data are temporarily stored, an engine interface for signal interface with the engine controller, a computer interface for signal interface with the host computer, and a CPU to control operation of the image processor based on the control programs stored in the ROM.

The CPU of the image processor produces a display list to produce image data from print data transmitted from the host computer via the communication interface, and stores the image data in the RAM after CMYK color correction. Then, the CPU of the image processor produces bitmap image data on a per color basis from the data stored in the RAM, and transmits the produced image data to the engine controller via the engine interface.

The engine controller includes a CPU to control operation of the image forming unit 2 and/or the paper feeder 3 under control of the image processor, a ROM in which a variety of control programs are stored, a RAM in which data generated by the control programs is temporarily stored, and an engine interface for input/output signal interface between the CPU of the engine controller and the engine interface of the image processor.

If a print start command is input from the image processor to the CPU of the engine controller via the engine interfaces, the CPU of the engine controller controls the paper feeding unit 4 or the paper feeder 3 to pick up paper. Thereafter, the CPU of the engine controller controls the image forming unit 2 to perform a print operation with respect to the bitmap data input from the image processor.

FIGS. 8A to 8D are views explaining an operation to move A4-size paper received in the second paper loader to the first paper loader provided in the paper feeder according to an embodiment.

Figure 8A:
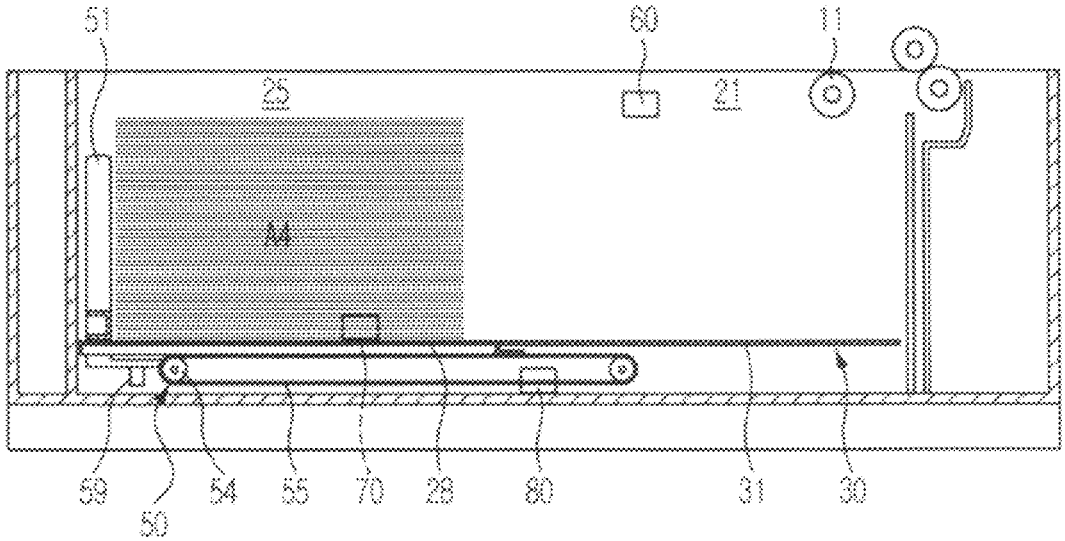
FIGS. 8A to 8D are views explaining an operation to move A4-size paper received in a second paper loader to a first paper loader provided in the paper feeder according to an embodiment.

As illustrated in FIG. 8A, first, the controller 90 perceives the size of paper (for example, A4-size) using user input information from the image forming control unit 100. Then, if the first paper sensor 60 senses that the first paper loader 21 is out of paper and the second paper sensor 70 senses the presence of paper on the second paper loader 25, the controller 90 lowers the elevating plate 31 to a preset position to allow the first paper loader 21 to receive the paper from the second paper loader 25.

Figure 8B:
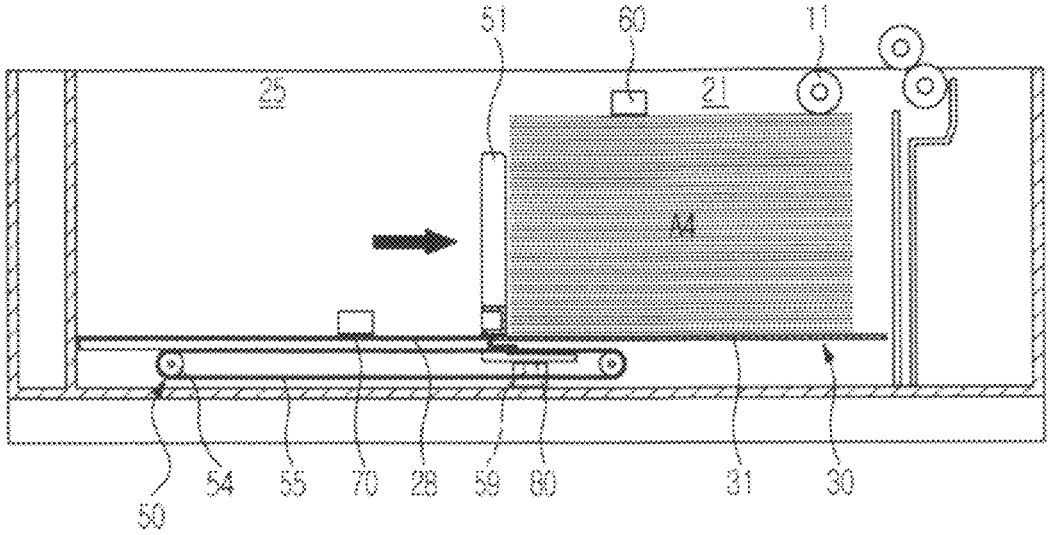

As illustrated in FIG. 8B, the controller 90 moves the moving member 51 forward in a direction designated by the arrow until the position sensor 80 senses the sensor bar 59 of the moving member 51, so as to move the A4-size paper loaded on the second paper loader 25 to the first paper loader 21.

Figure 8C:
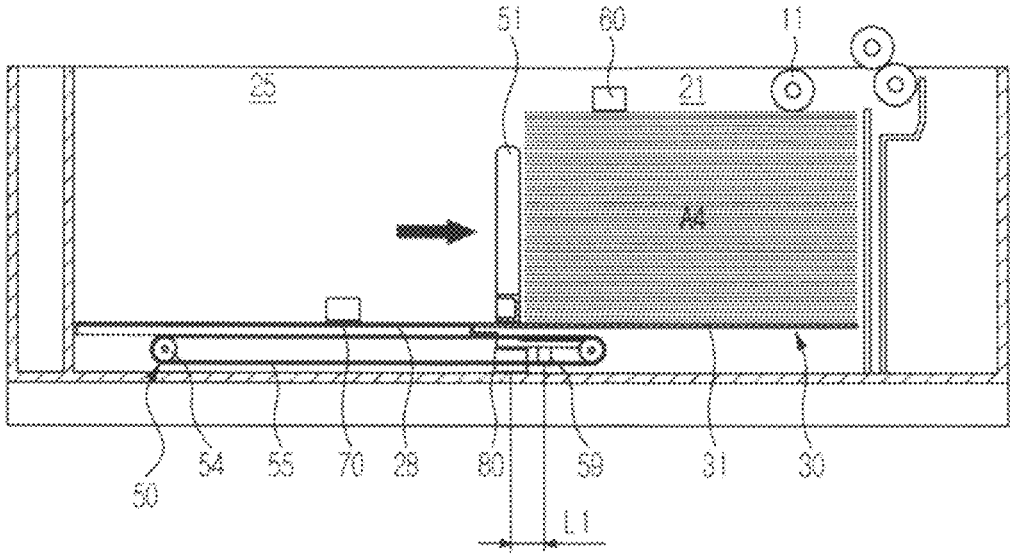

As illustrated in FIG. 8C, if the position sensor 80 senses the sensor bar 59 of the moving member 51 during movement of the moving member 51, in consideration of the fact that the paper loaded on the second paper loader 25 is A4-size paper, the controller 90 stops the moving member 51 at a position or at a time when the sensor bar 59 is further moved from the position sensor 80 by a preset distance L1 corresponding to the A4-size paper. As such, the A4-size paper loaded on the second paper loader 25 is accurately moved to an appropriate position on the first paper loader 21.

Figure 8D:
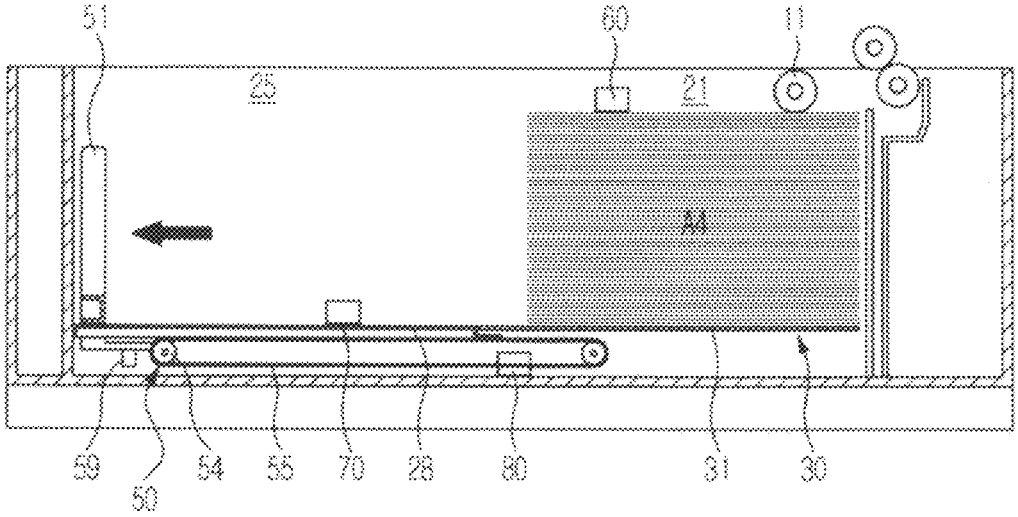

As illustrated in FIG. 8D, after completion of the paper movement, the controller 90 returns the moving member 51 to an original position thereof in a direction designated by the arrow. Simultaneously, the elevating plate 31 is raised to allow the paper to be fed from the first paper loader 21 to the image forming unit 2. In doing so, the uppermost sheet of A4-size paper loaded on the first paper loader 21 is picked up by the pickup roller 11 and is moved into the image forming unit 2.

Figure 9:
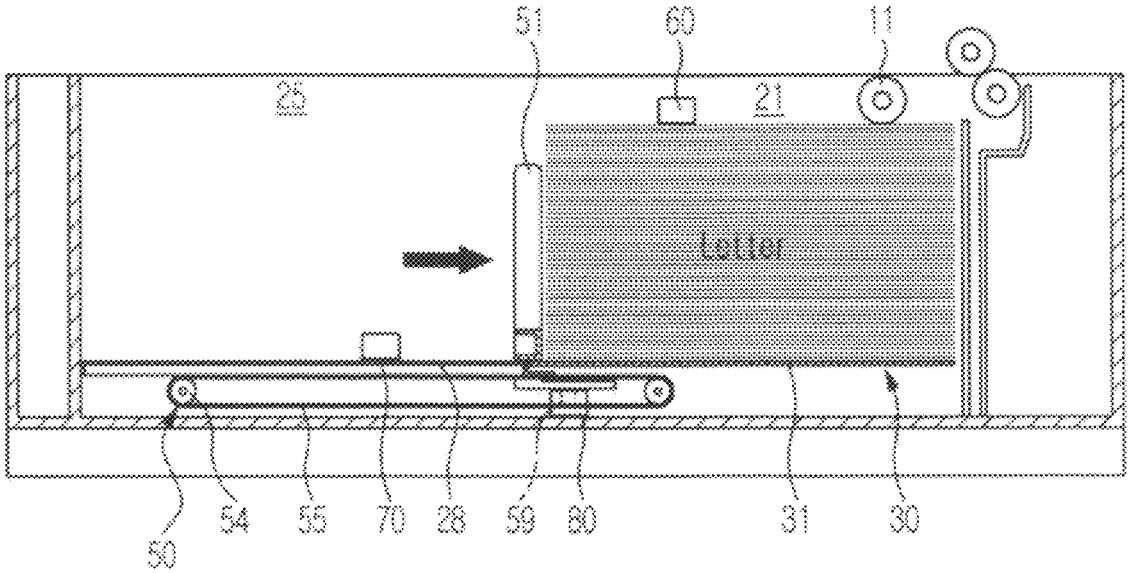
FIG. 9 is a view explaining an operation to move letter-size paper received in the second paper loader to the first paper loader provided in the paper feeder according to an embodiment.

FIG. 9 is a view explaining an operation to move letter-size paper received in the second paper loader to the first paper loader provided in the paper feeder according to an embodiment.

As illustrated in FIG. 9, if user input information indicates that the paper loaded on the second paper loader 25 is letter-size, the controller 90 moves the moving member 51 forward in a direction designated by the arrow until the position sensor 80 senses the sensor bar 59 of the moving member 51, so as to move the letter-size paper loaded on the second paper loader 25 to the first paper loader 21 and then, stops the moving member 51 if the position sensor 80 senses the sensor bar 59. In this case, since the letter-size paper is larger than the A4-size paper, the moved distance of the moving member 51 will be shorter than in the case of the A4-size paper. As such, the letter-size paper loaded on the second paper loader 25 is accurately moved to an appropriate position on the first paper loader 21.

Figure 10:
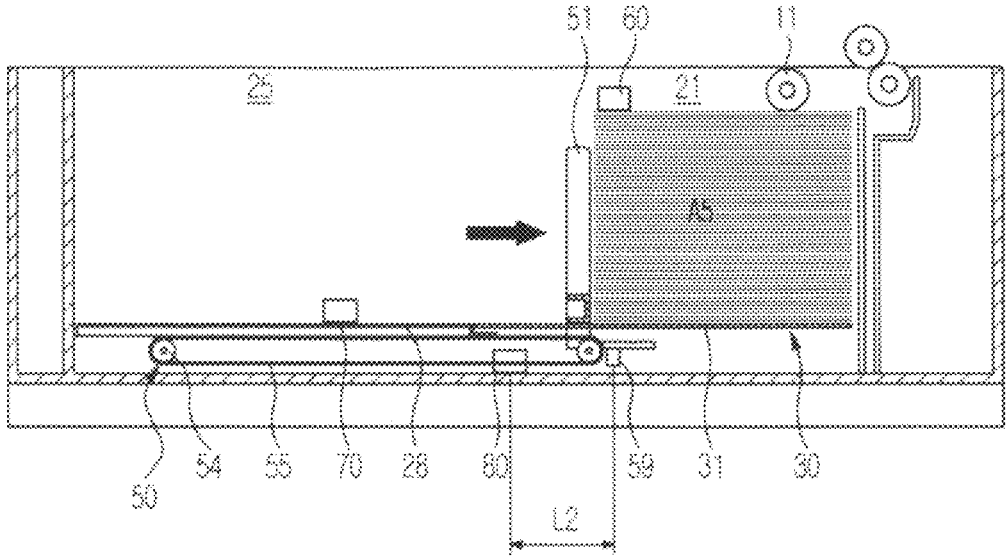
FIG. 10 is a view explaining an operation to move A5-size paper received in the second paper loader to the first paper loader provided in the paper feeder according to an embodiment.

FIG. 10 is a view explaining an operation to move A5-size paper received in the second paper loader to the first paper loader provided in the paper feeder according to an embodiment.

As illustrated in FIG. 10, if user input information indicates that the paper loaded on the second paper loader 25 is A5-size, the controller 90 moves the moving member 51 forward in a direction designated by the arrow until the position sensor 80 senses the sensor bar 59 of the moving member 51, so as to move the A5-size paper loaded on the second paper loader 25 to the first paper loader 21. Then, if the position sensor 80 senses the sensor bar 59, the controller 90 stops the moving member 51 at a position or at a time when the sensor bar 59 is further moved from the position sensor 80 by a preset distance L2 corresponding to the A5-size paper. In this case, since the A5-size paper is smaller than the A4-size paper, the moved distance of the moving member 51 will be greater than in the case of the A4-size paper. As such, the letter-size paper loaded on the second paper loader 25 is accurately moved to an appropriate position on the first paper loader 21.

Figure 11:
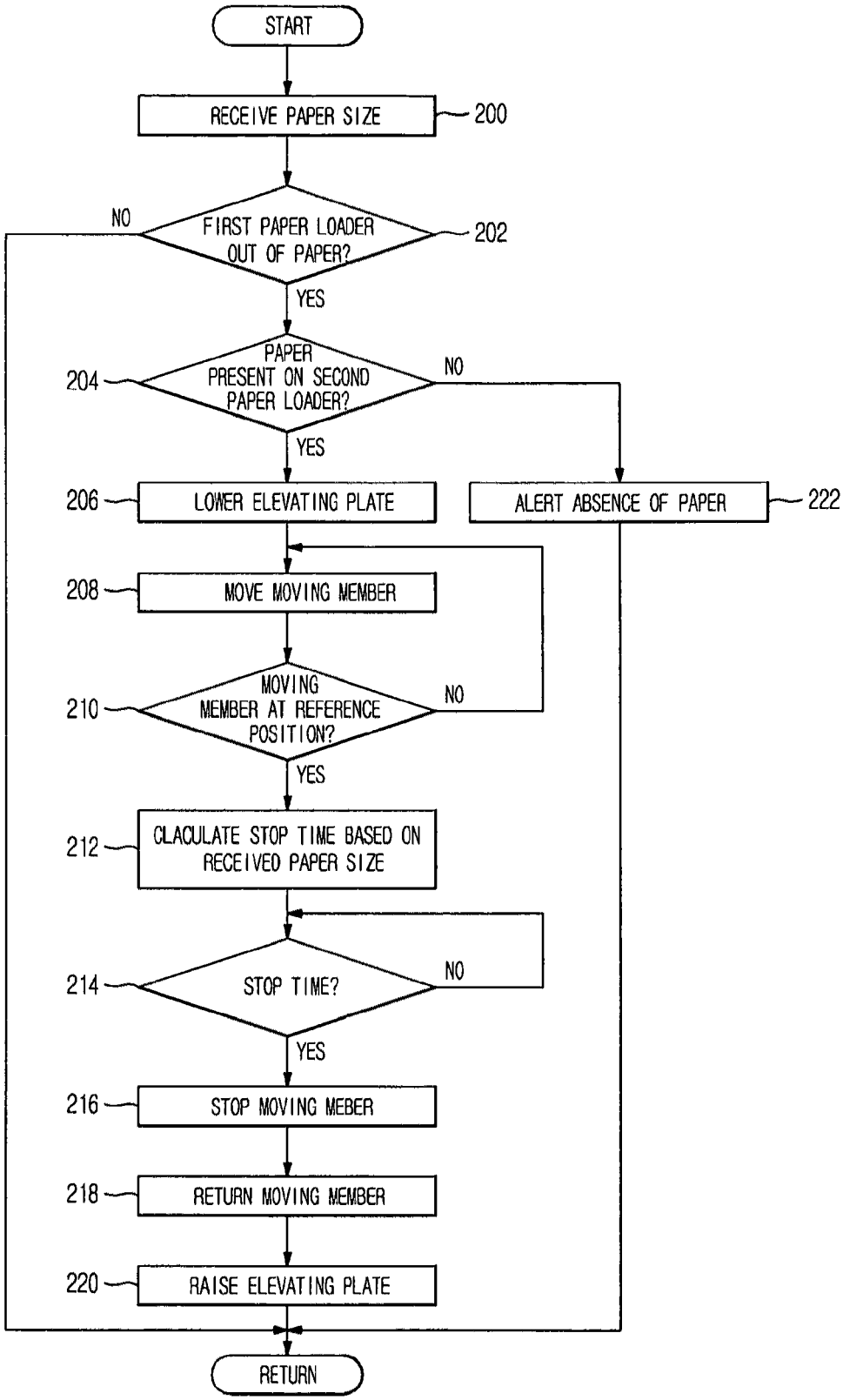
FIG. 11 is a flow chart illustrating a control method of the paper feeder according to an embodiment.

FIG. 11 is a flow chart illustrating a control method of the paper feeder according to an embodiment.

Referring to FIG. 11, the controller 90 receives information related to the size of paper loaded on the second paper loader 25 from the image forming control unit 100 (200).

After receiving the information related to the size of paper loaded on the second paper loader 25, the controller 90 judges (determines) whether or not the first paper loader 21 is out of paper based on a signal from the first paper sensor 60 (202).

If the first paper loader 21 is out of paper, the controller 90 judges (determines) whether or not the paper is present on the second paper loader 25 based on a signal from the second paper sensor (204).

If a judgment result of operation mode 204 shows that the paper is present on the second paper loader 25, the controller 90 lowers the elevating plate 31 to enable movement of the paper from the second paper loader 25 to the first paper loader 21 (206).

After lowering the elevating plate 31, the controller 90 moves the moving member 51 so as to move the paper from the second paper loader 25 to the first paper loader 21 (208). As such, the paper loaded on the second paper loader 25 is pushed by the moving member 51, thereby being moved to the first paper loader 21.

After moving the moving member 51, the controller 90 judges (determines) whether or not the moving member 51 has reached a reference position based on a signal from the position sensor 80 (210). When the moving member 51 the position sensor 80 senses the sensor bar 59 of the moving member 51, the moving member 51 is determined to have reached the reference position.

If a judgment result of operation mode 210 shows that the moving member 51 has reached the reference position, the controller 90 calculates a stop time of the moving member 51 based on the size of paper obtained from operation mode 200 (212). In this case, the controller 90 calculates a variable stop time based on the paper size.

In one example, if the letter-size paper is employed, the controller 90 calculates the stop time of the moving member 51 as the time when the sensor bar 59 is sensed by the position sensor 80.

In another example, if the A4-size paper is employed, the controller 90 calculates the stop time of the moving member 51 as the time when the sensor bar 59 is further moved by the preset distance L1 after being sensed by the position sensor 80.

In a further example, if the A5-size paper is employed, the controller 90 calculates the stop time of the moving member 51 as the time when the sensor bar 59 is further moved by the preset distance L2 that is longer than the preset distance L1 utilized in the case of the A4-size paper after being sensed by the position sensor 80.

After calculating the stop time based on the paper size, the controller 90 judges whether or not the calculated stop time has been reached (214).

If a judgment result of operation mode 214 shows that the calculated stop time has been reached, the controller 90 stops the moving member 51 (216). As such, movement of the paper to an accurate position on the first paper loader 21 is accomplished regardless of the size of paper loaded on the second paper loader 25.

After stopping the moving member 51, the controller 90 returns the moving member 51 to an original position (218).

After returning the moving member 51 to the original position, the controller 90 raises the elevating plate 31 until the paper loaded on the first paper loader 21 reaches a correct paper feeding height (220).

On the other hand, if a judgment result of operation mode 204 shows that no paper is present on the second paper loader 25, the controller 90 alerts the user of the absence of paper via the display unit 130 of the image forming control unit 100 (222).

Although the above embodiment describes the stop time or movement distance of the moving member 51 as being variable based on the paper size and based on when the sensor bar 59 of the moving member 51 is sensed by the position sensor 80 during movement of the moving member 51, the embodiment is not limited thereto. In another alternative embodiment, instead of installing the position sensor 80, the stop time or movement distance of the moving member 51 may be varied based on the paper size and based on when the moving member 51 begins to move.

As is apparent from the above description, according to an embodiment, with regard to operation of a moving member to push paper loaded on one paper loader to another empty paper loader, the stop time of the moving member is variable based on a paper size input by a user, which enables a stop position of the moving member to be automatically adjusted based on the paper size, resulting in enhanced user convenience.

Further, according to an embodiment, as the stop time of the moving member is automatically adjusted based on the paper size, it is unnecessary to adjust a position of a sensor used to sense the movement of paper by the moving member even if the paper size is changed, which prevents the need for troublesome retuning of the sensor.

Furthermore, according to an embodiment, the stop time of the moving member is variable without any sensor to sense the paper size, which results a reduction in manufacturing costs.

Although embodiments have been shown and described, it would be appreciated by those skilled in the art that changes may be made in these embodiments without departing from the principles and spirit of the disclosure, the scope of which is defined in the claims and their equivalents.

What is claimed is:

1. A paper feeder comprising:

a paper feeder housing provided in an image forming apparatus;

a first paper loader placed in the paper feeder housing to load paper to be fed into the image forming apparatus;

a second paper loader placed in the paper feeder housing to load paper to be fed into the first paper loader;

a movement unit having a moving member to move the paper loaded on the second paper loader to the first paper loader; and a controller to control the movement unit such that the moving member is moved to move the paper loaded on the second paper loader to the first paper loader if the first paper loader is out of paper and such that a stop time of the moving member is variable based on the size of paper input by a user during movement of the moving member.

2. The paper feeder according to claim 1, wherein the controller varies the stop time of the moving member on a per paper size basis based on when the moving member has reached a reference position.

3. The paper feeder according to claim 2, further comprising a sensor to sense that the moving member has reached the reference position.

4. The paper feeder according to claim 1, wherein the controller varies the stop time of the moving member on a per paper size basis based on when the moving member begins to move.

5. The paper feeder according to claim 1, wherein the controller receives the size of paper input by the user from the image forming apparatus.

6. A control method of a paper feeder comprising a first paper loader placed in a paper feeder housing of an image forming apparatus to load paper to be fed into the image forming apparatus, a second paper loader placed in the paper feeder housing to load paper to be fed into the first paper loader, and a moving member to move the paper loaded on the second paper loader to the first paper loader, the control method comprising:

receiving a paper size input by a user;

moving the moving member to move the paper loaded on the second paper loader to the first paper loader if the first paper loader is out of paper; and stopping the moving member at a stop time variably set based on the received paper size.

7. The control method according to claim 6, wherein stopping the moving member a the stop time variably set based on the received paper size includes sensing that the moving member has reached a reference position using a sensor, calculating the stop time of the moving member on a per paper size basis based on when the moving member has reached the reference position, and stopping the moving member at the calculated stop time.

8. The control method according to claim 7, wherein the variably set stop time of the moving member decreases as the received paper size increases and the variably set stop time of the moving member increases as the received paper size decreases.

9. The control method according to claim 6, wherein stopping the moving member at the stop time variably set based on the received paper size includes calculating the stop time of the moving member on a per paper size basis based on when the moving member begins to move, and stopping the moving member at the calculated stop time.

10. The control method according to claim 9, wherein the calculated stop time of the moving member decreases as the received paper size increases and wherein the calculated stop time of the moving member increases as the received paper size decreases.

11. An image forming apparatus comprising:

a paper feeder housing;

a first paper loader placed in the paper feeder housing to load paper to be fed into an image forming unit;

a second paper loader placed in the paper feeder housing to load paper to be fed into the first paper loader;

a movement unit having a moving member to move the paper loaded on the second paper loader to the first paper loader;

an input unit to receive a paper size from a user;

an image forming control unit to control the image forming apparatus and to transmit the paper size input via the input unit; and a controller to control the movement unit such that the moving member is moved to move the paper loaded on the second paper loader to the first paper loader if the first paper loader is out of paper and such that a stop time of the moving member is variable based on the size of paper transmitted from the image forming control unit during movement of the moving member.

12. The image forming apparatus according to claim 11, further comprising a sensor to sense that the moving member has reached a reference position, wherein the controller varies the stop time of the moving member on a per paper size basis based on when the moving member has reached the reference position.

13. The image forming apparatus according to claim 12, wherein the controller varies the stop time of the moving member such that the stop time decreases as the paper size transmitted from the image forming control unit increases and such that the stop time increases as the paper size transmitted from the image forming control unit decreases.

14. The image forming apparatus according to claim 11, wherein the controller varies the stop time of the moving member on a per paper size basis based on when the moving member begins to move.

15. The image forming apparatus according to claim 14, wherein the controller varies the stop time of the moving member such that the stop time decreases as the paper size transmitted from the image forming control unit increases and such that the stop time increases as the paper size transmitted from the image forming control unit decreases.

16. A paper feeder comprising:

first and second paper loaders to load paper thereon;

a movement unit having a moving member to move the paper loaded on the second paper loader to the first paper loader; and a controller to control the moving member to move the paper loaded on the second paper loader to the first paper loader if the first paper loader is out of paper and to vary a movement distance of the moving member based on the size of paper input by a user during movement of the moving member.

17. The paper feeder according to claim 16, wherein the controller varies the movement distance of the moving member such that the movement distance decreases as the input paper size increases and such that the movement distance increases as the input paper size decreases.

18. The paper feeder according to claim 17, further comprising a sensor to sense that the moving member has reached a reference position, wherein the controller varies the movement distance of the moving member on a per paper size basis based on when the moving member has reached the reference position.

19. A control method of a paper feeder to feed paper to an image forming apparatus, the control method comprising:

receiving a paper size input by a user;

moving a moving member to move the paper loaded on a paper loader to another paper loader if the paper loader is out of paper; and stopping the moving member at a stop time variably set based on the received paper size.

* * * * *

UNITED STATES PATENT AND TRADEMARK OFFICE

CERTIFICATE OF CORRECTION

PATENT NO. : 8,398,069 B2
APPLICATION NO. : 13/137858
DATED : March 19, 2013
INVENTOR(S) : Seok Heon Chae et al.

It is certified that error appears in the above-identified patent and that said Letters Patent is hereby corrected as shown below:

In the Claims:

Column 13, Line 31, In Claim 7, after "member" delete "a" and insert --at--, therefor.

Signed and Sealed this
Sixteenth Day of July, 2013

Teresa Stanek Rea
*Acting Director of the United States Patent and Trademark Office*